US007675395B2

(12) United States Patent
Day et al.

(10) Patent No.: US 7,675,395 B2
(45) Date of Patent: Mar. 9, 2010

(54) ELECTROMAGNET HAVING SPACER FOR FACILITATING COOLING AND ASSOCIATED COOLING METHOD

(75) Inventors: Arthur C. Day, Seattle, WA (US); Philip E. Johnson, Auburn, WA (US); B. David Stanley, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 113 days.

(21) Appl. No.: 11/424,577

(22) Filed: Jun. 16, 2006

(65) Prior Publication Data

US 2006/0218790 A1 Oct. 5, 2006

Related U.S. Application Data

(62) Division of application No. 10/763,522, filed on Jan. 23, 2004, now Pat. No. 7,088,210.

(51) Int. Cl.
*H01F 27/08* (2006.01)
*H01F 27/30* (2006.01)
*H01F 5/00* (2006.01)

(52) U.S. Cl. ..... 336/60; 336/199; 336/207; 335/300

(58) Field of Classification Search ..... 335/300; 336/55–62, 199, 207, 185; 310/52, 54, 58, 310/59, 65; 165/80.4, 169
See application file for complete search history.

(56) References Cited

U.S. PATENT DOCUMENTS 1,636,266 A * 7/1927 Wilkinson ..... 336/57
1,929,187 A * 10/1933 Johnson ..... 336/59
2,205,236 A * 6/1940 Hewett ..... 336/207
2,761,101 A * 8/1956 Gugliehno et al. ..... 361/37
2,863,130 A * 12/1958 Gray et al. ..... 336/207
3,054,974 A * 9/1962 Rabins ..... 336/60
3,056,071 A * 9/1962 Baker et al. ..... 335/300
3,170,225 A * 2/1965 Gray et al. ..... 29/605
3,368,174 A * 2/1968 Fischer ..... 336/60
3,386,058 A * 5/1968 Michel ..... 336/60
3,408,619 A * 10/1968 Schrader ..... 335/216
3,431,443 A * 3/1969 Essen ..... 310/65
3,559,126 A * 1/1971 Drautman, Jr. ..... 335/216
3,597,645 A * 8/1971 Duffert et al. ..... 310/14
3,789,337 A 1/1974 Sheppard
3,828,211 A * 8/1974 Laronze ..... 310/13
4,270,112 A 5/1981 Schneider-Muntau et al.
4,341,966 A * 7/1982 Pangburn ..... 310/61
4,352,034 A * 9/1982 Karhan et al. ..... 310/59
4,363,773 A 12/1982 Mine
4,516,044 A * 5/1985 Bone ..... 310/64
4,529,955 A * 7/1985 Schuster et al. ..... 335/300

(Continued)

*Primary Examiner*—Elvin G Enad
*Assistant Examiner*—Alexander Talpalatskiy
(74) *Attorney, Agent, or Firm*—Alston & Bird LLP

(57) ABSTRACT

An electromagnet and associated apparatus and method are provided. The electromagnet includes a core and at least one winding disposed circumferentially about the core such that the winding extends at least one revolution around the core. The electromagnet further includes at least one spacer having channels defined therein and disposed circumferentially about the core and adjacent to the at least one winding. The channels facilitate cooling by directing fluid about the windings of the coil as fluid is introduced into the electromagnet.

20 Claims, 6 Drawing Sheets

U.S. PATENT DOCUMENTS

| | | | | |
|---|---|---|---|---|
| 4,584,551 | A | 4/1986 | Burgher et al. | |
| 4,593,261 | A * | 6/1986 | Forster et al. | 335/300 |
| 4,783,628 | A | 11/1988 | Huson | |
| 4,822,772 | A | 4/1989 | Huson | |
| 5,367,760 | A | 11/1994 | Terlop | |
| 5,430,426 | A | 7/1995 | Griebel | |
| 5,651,175 | A * | 7/1997 | Grimes et al. | 29/605 |
| 6,157,282 | A | 12/2000 | Hopkinson | |
| 6,222,289 | B1 * | 4/2001 | Adames | 310/54 |
| 6,357,101 | B1 | 3/2002 | Sarh et al. | |
| 2002/0003462 | A1 | 1/2002 | Stolk | |
| 2003/0221306 | A1 | 12/2003 | Day et al. | |

* cited by examiner

ELECTROMAGNET HAVING SPACER FOR FACILITATING COOLING AND ASSOCIATED COOLING METHOD

CROSS-REFERENCE TO RELATED APPLICATIONS

This application is a divisional of U.S. application Ser. No. 10/763,522, filed Jan. 23, 2004, now U.S. Pat. No. 7,088,210 which is hereby incorporated herein in its entirety by reference.

BACKGROUND OF THE INVENTION

1) Field of the Invention

The present invention relates to electromagnets and, more particularly, to an electromagnet having a spacer that defines channels that facilitate cooling of the electromagnet, as well as an associated apparatus and method.

2) Description of Related Art.

Electromagnets are used for various purposes, such as in motors, generators, solenoids, back-up power systems, and transformers. One common application for electromagnets is to provide the actuator mechanism during the installation of rivets or other fasteners, such as in large airframe structures including wing skins, fuselage skins, and the like. Additionally, electromagnets can be used to clamp multiple structures together while drilling or performing a tooling operation on the clamped structures, thereby resulting in a burr-less and debris-free hole. Similarly, an electromagnet may be used to clamp structures together while inserting a rivet or similar fastener to attach the structures. Clamping generally occurs when an electromagnet is positioned adjacent to a structure, and a ferrous material is positioned on the other side of the structure to create a clamping force between the electromagnet and ferrous material.

In most basic principles, the electrical energy input to an electromagnet creates mechanical energy output. Electromagnets generally comprise a coil and ferromagnetic core. The coil generally surrounds the core. As a current is passed through the coil, a magnetic field is created in the vicinity, and the core becomes magnetized and attracts any magnetic material. The force of the magnetic field can be adjusted by changing the number of windings comprising the coil or the amount of current applied to the coil. Electromagnets may be classified as either DC (direct-current) or AC (alternating current), and the type of core depends on which type of current is provided. In either case, as DC or AC is applied to the coil, resistive losses in the coil lead to heat production. As heat increases, methods for cooling the coil become necessary to remove the excess heat and assure consistent performance. Generally, forced convection and water-cooling are methods used to cool electromagnets.

Specifically, some electromagnet coils are cooled by using a hollow winding and then circulating fluid through the winding. This technique requires high current power supplies and powerful pumps to drive the fluid through a long, narrow passageway. Another technique is bathing the coil in a fluid to conduct heat from the coil to the fluid. Alternatively, layers of the coil may be separated by spacers to facilitate fluid flow, as is most commonly used with large transformers for utility power equipment. The spacers used with electrical utilities are commonly stacked lengthwise along the core and are typically large (about 12 inches in diameter and 12 inches in thickness). However, this technique is not often space efficient and does not offer the degree of cooling that could be provided by a more effective system of fluid circulation about the coils.

It would therefore be advantageous to provide an improved technique for cooling electromagnet coils, such as an improved spacer that is capable of effectively cooling the coils of a magnetized electromagnet. Also, it would be advantageous to provide a spacer that is capable of cooling the electromagnet coils with reduced current and power requirements. Finally, it would be advantageous to provide a spacer that effectively provides coolant to the electromagnet and that is easy to fabricate and install.

BRIEF SUMMARY OF THE INVENTION

The invention addresses the above needs and achieves other advantages by providing an improved electromagnet including a spacer for facilitating cooling of the electromagnet. The spacer includes channels, which facilitate fluid flow along the coil of the electromagnet to provide more effective circulation across the coils. The channels direct fluid both circumferentially and longitudinally along the coil to ensure that the fluid contacts a substantial percentage of surface area on each winding to cool the coil.

In one embodiment, the electromagnet includes a core and at least one winding disposed circumferentially about the core such that the winding extends at least one revolution around the core. The electromagnet further includes at least one spacer having channels defined therein and disposed circumferentially about the core and adjacent to the at least one winding.

The channels may extend in a generally longitudinal direction along the core, such as with a lattice of diagonally extending channels. Alternatively, the channels may extend in a generally circumferential direction about the core, such as with linked parallel strips. Preferably, there are alternating windings and spacers disposed circumferentially about the core such that each spacer is adjacent to a winding and, more typically, disposed between layers of windings to provide cooling of an adjacent surface of each winding.

The electromagnet may further comprise a first endplate defining an inlet and a second endplate defining an outlet. In addition, a housing may also extend circumferentially about the winding and spacer and between the first and second endplates such that the winding and spacer are enclosed. The first endplate may define channels having a substantially serpentine configuration, thereby defining a path for a coolant medium through the inlet, about the channels defined in the first endplate, through the channels defined in the spacer, and out of the outlet.

In another aspect, an electromagnet includes a core and at least one winding disposed circumferentially about the core such that the winding extends at least one revolution around the core. The electromagnet also includes at least one spacer disposed circumferentially about the core and adjacent to the at least one winding, wherein the spacer defines channels therein. Further, a current source, such as a drill motor, is electrically coupled to the electromagnet, such that the current source is capable of directing current through the at least one winding.

The present invention also provides a method for cooling an electromagnet. The method includes providing an electromagnet having at least one spacer defining channels therein and a coil comprising at least one winding. The electromagnet further includes a first endplate defining an inlet and a second endplate defining an outlet, wherein the first and second endplates are adjacent to opposite ends of a housing such that the coil and spacer are enclosed. Additionally, the method includes magnetizing the electromagnet by providing a current to the coil, and supplying a cooling medium into the inlet defined within the first endplate and through the channels of the spacer and out of the outlet defined within the second endplate while current is flowing through the winding.

The present invention therefore provides an improved electromagnet and method for cooling an electromagnet. The spacers offer improved circulation of coolant about the coils by distributing the coolant both circumferentially and longitudinally along the coils of the electromagnet. The spacers include different designs for accommodating different coils and impart different cooling properties to the electromagnet. By including a spacer between each winding layer, each winding of the coil will be adjacent to a spacer such that the coil is uniformly cooled. Providing an efficient cooling spacer will in turn increase the efficiency of the electromagnet by reducing heat, as well as reducing the size of the electromagnet.

The electromagnet of the present invention is easily manufactured and is capable of being used for a variety of applications. The spacer may be advantageously machined or molded in a planar state and subsequently wrapped about a coil. Thus, different lengths of spacers are easily machined or molded, and the material used for the spacer provides flexibility for wrapping about the coil and maintaining its shape, as well as not damaging the adjacent windings or coils. In addition, the material chosen for the spacer can be easily sized to match the coil dimensions and does not bunch up or require any adjustments.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
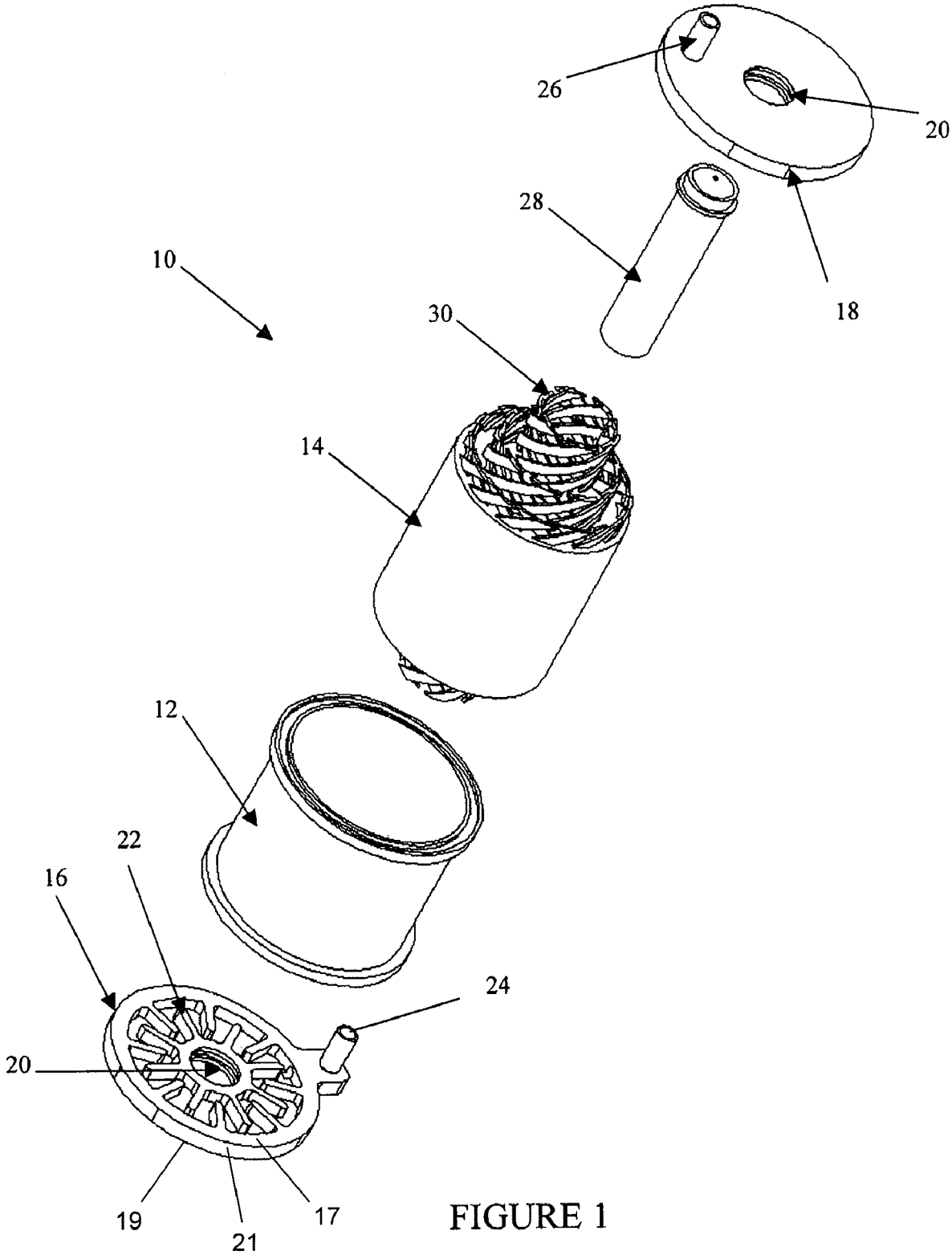
FIG. 1 is an exploded perspective view of an electromagnet including a spacer of one embodiment of the present invention.

Referring now to the drawings and, in particular to FIG. 1, there is shown an electromagnet 10. The term "electromagnet" is not meant to be limiting, and it is understood that the term electromagnet could be any device that utilizes current passed through revolutions of conductive wire windings wrapped about a core to create a magnetic field about the core, and causing the core to become magnetized when the core is made of a material of high magnetic permeability. The term electromagnet is also meant to apply to any similar device utilizing an air core or other non-permeable material. Thus, the electromagnet could be used in any number of applications, such as in motors, generators, back-up power systems, transformers, clamps, and the like. In addition, the electromagnet could be useful for improving avionics including radar systems utilizing solenoid-based beam power tubes, and possibly to high power density rack-mounted equipment with magnetic devices such as transformers for power supplies and voltage converters.

The electromagnet 10 shown in FIG. 1 includes an outer housing 12 and inner housing 14, as well as endplates 16, 18 that align substantially adjacent to the ends of the outer and inner housings. Each endplate 16, 18 defines an opening 20 and may also define distribution channels 22. For example, FIG. 1 illustrates that the endplate 16 includes first 17 and second 19 opposing surfaces and that the distribution channels 22 are defined in the first surface and at least partially within the thickness 21 extending between the opposing surfaces. Endplate 16 includes an inlet port 24, while endplate 18 includes an outlet port 26. While the inlet port 24 and outlet port 26 denote a direction of fluid flow as described below, the direction of fluid flow may be reversed if desired. A core 28 is provided that inserts within the openings 20 defined within the endplates 16, 18, although the core may alternatively be affixed to the end plates in other manners. Generally, alternating layers of spacers 30 and windings 32 (not shown in FIG. 1) are wrapped about the core 28 adjacent to one another. Generally multiple windings 32 form a coil 34 (not shown), although the coil could be a single winding. The coil 34, in turn, is dispersed within the inner housing 14 as shown.

If an AC current is used to energize the electromagnet 10, the aforementioned components of the electromagnet, except for the coil 34, are preferably made of a relatively high resistivity material, such as cobalt-iron alloys, iron-nickel alloys, iron-silicon alloys, and the like, and may be laminated (constructed of thin layers) in order to reduce power loss and heating due to eddy currents in the material. In various embodiments of the electromagnet, for example, the high resistivity material may be Hiperco™ material, commercially available from Carpenter Technology Corporation, or Metglass™ material, commercially available from Allied Signal, Inc., although the material could be any similar alloy or like material. When DC current is used, the same materials could be utilized, but the material would not need to be laminated.

The wire comprising the coil 34 may be made of any type of conductive material, such as copper. In addition, the cross-section of the wire may be shaped as desired, such as a square cross-section wire, commercially available from MWS Wire Industries, for ease of winding and/or stacking of windings. In other embodiments, at least a portion of the wire may have a circular, oval, or other cross-sectional shape. The wire that is utilized in winding 32 may be a "magnet wire," as known to those skilled in the art, and may have a relatively thin insulation layer. The insulation may include formvar or polyimide, or a similar coating. Regardless of the type or cross-section of the wire, in some embodiments, 16-gauge wire and lower (larger wire) may conveniently be utilized for ease of winding. For instance, in the embodiments of the electromagnet in which the winding 32 includes 16-gauge wire or larger, a square cross section would provide the best conductive heat transfer in accordance with one embodiment of the present invention, although it is understood that any gauge of wire and cross section could be used.

The core 28 is typically made of a high-permeability material, where the relative permeability of the material is defined as a ratio of the strength of the magnetic field with the material to the strength of the magnetic field without the material. For example, the relative permeability of steel utilized in embodiments of the present invention is typically at least 100. For instance, the core 28 may be made of high-permeability ferrous material, such as 1010, 1018, 1020 low-carbon steel, or the like. In various embodiments of the electromagnet 10, for example, the core 28 may be made of Hiperco™ 50 material, commercially available from Carpenter Technology Corporation, or any other type of iron cobalt magnetic alloys, and/or carbon steel that has a relatively high saturation flux density and a relatively high permeability.

In some embodiments of the electromagnet 10, the core 28 may have a circular cross-section, but in other embodiments, the core may have other cross-sections, such as a square-circumferential shape, depending upon the application of the electromagnet. The shape, and in particular, the smallest lateral dimension of the core 18 is optimized to create the maximum amount of flux density, and therefore force, as known to those skilled in the art. In general, the size of the core 28 is optimized when an additional increase in the core size substantially reduces the flux density in the core.

Figure 2:
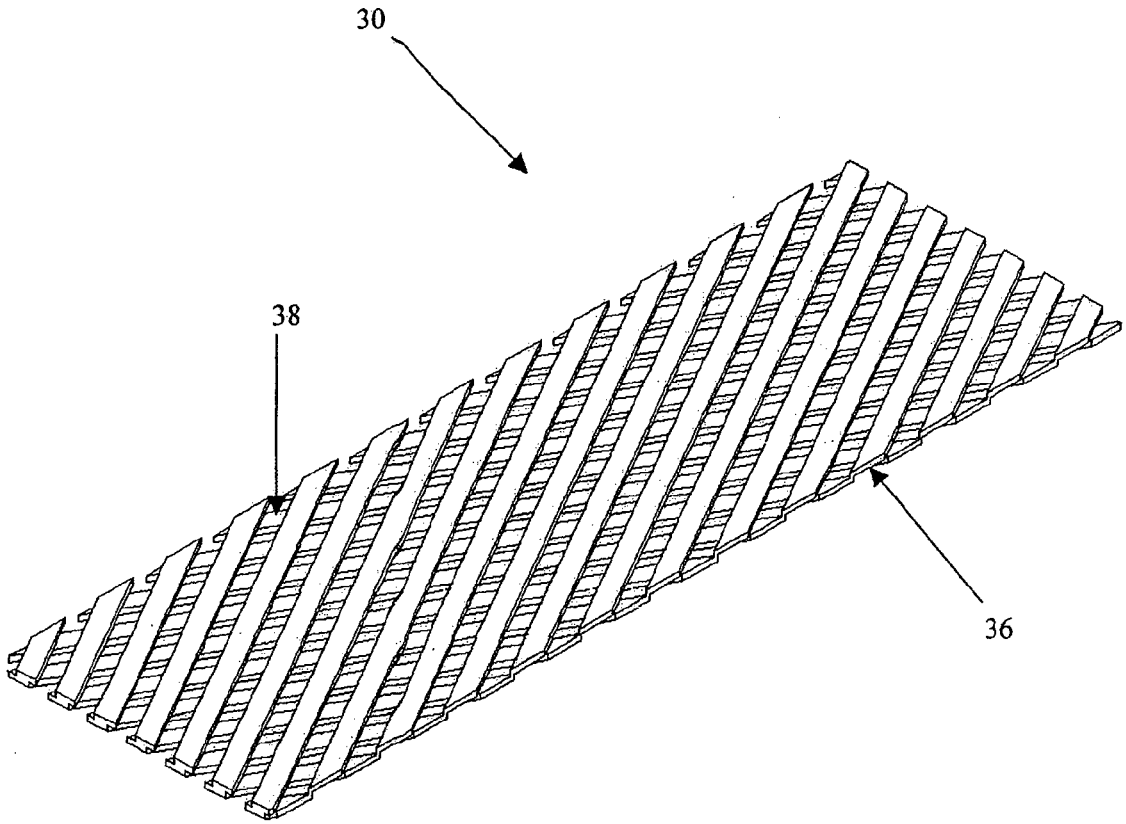
FIG. 2 is a perspective view of one embodiment of a cooling spacer.
Figure 3:
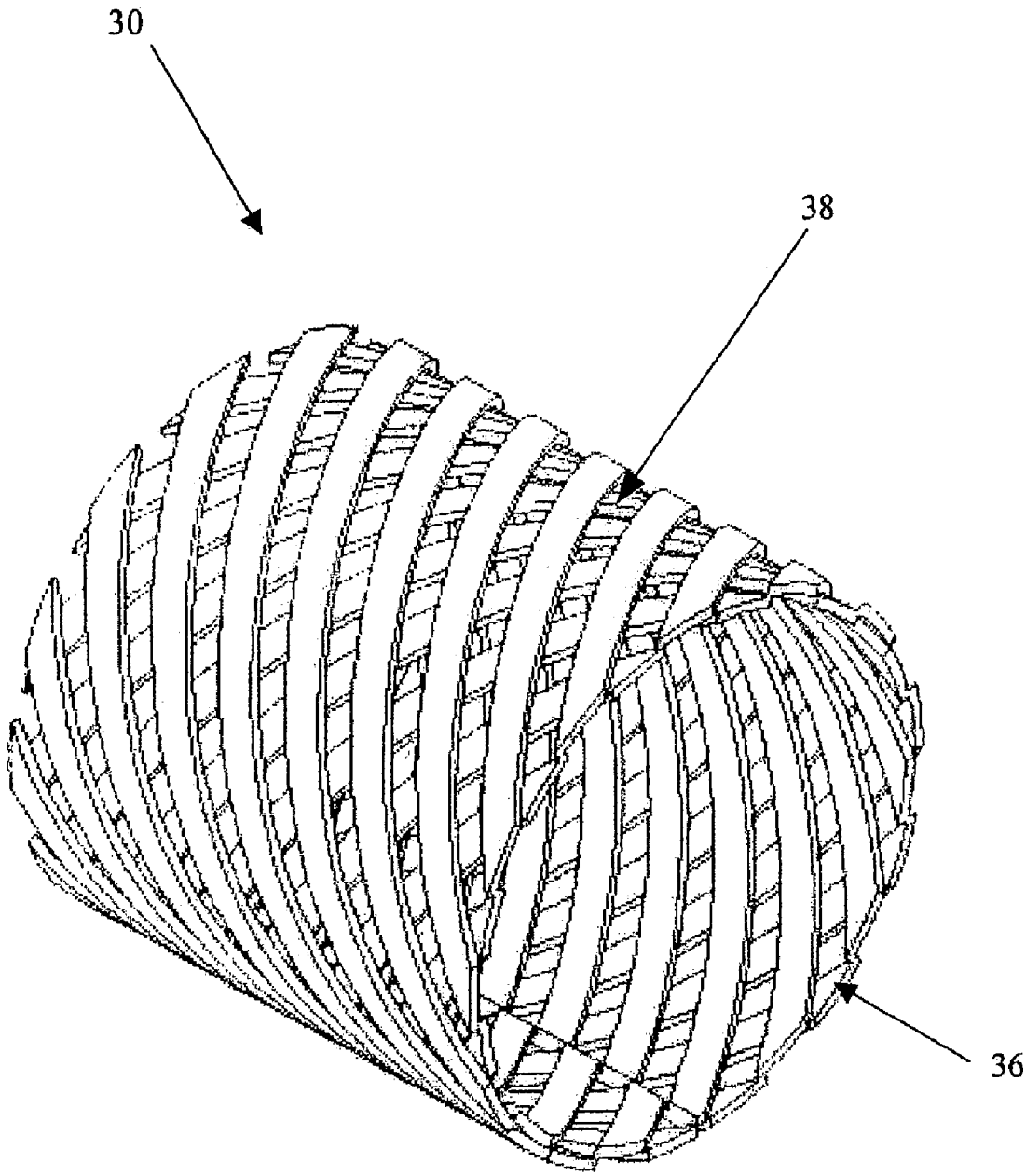
FIG. 3 is another perspective view of the cooling spacer of FIG. 2 showing the cooling spacer as it would wrap circumferentially over a layer of windings.

When the electromagnet 10 is energized, the temperature of the coil 34 increases, and the electromagnet 10 may require cooling, at least during times of electromagnet operation. To facilitate cooling, spacers 30 may be placed between the revolutions of winding 32. FIGS. 2 and 3 illustrate a spacer 30 of one embodiment of the present invention. The spacer 30 defines a plurality of inner 36 and outer 38 grooves arranged in a mesh pattern. The inner 36 and outer 38 grooves are arranged diagonally, which provide channels for fluid to flow when fluid enters the electromagnet 10. Thus, the channels direct fluid both longitudinally along the length of the core 28 and circumferentially about the core.

The inner 36 and outer 38 grooves may have various sizes depending, at least in part, upon the capacity of coolant that the grooves are designed to carry. For example, the grooves can be about 0.050 to 0.200 inches in width, in instances where a wire gauge of 18 or larger is used. The spacer 30 can similarly have various thicknesses, such as about 0.050 inches or less in one embodiment. Further, the width and length of the spacer 30 are generally such that the spacer completely encompasses the underlying winding 32. Thus, the spacer 30 is advantageously sized to extend substantially between the endplates 16, 18 and circumferentially about the winding 32.

Figure 4:
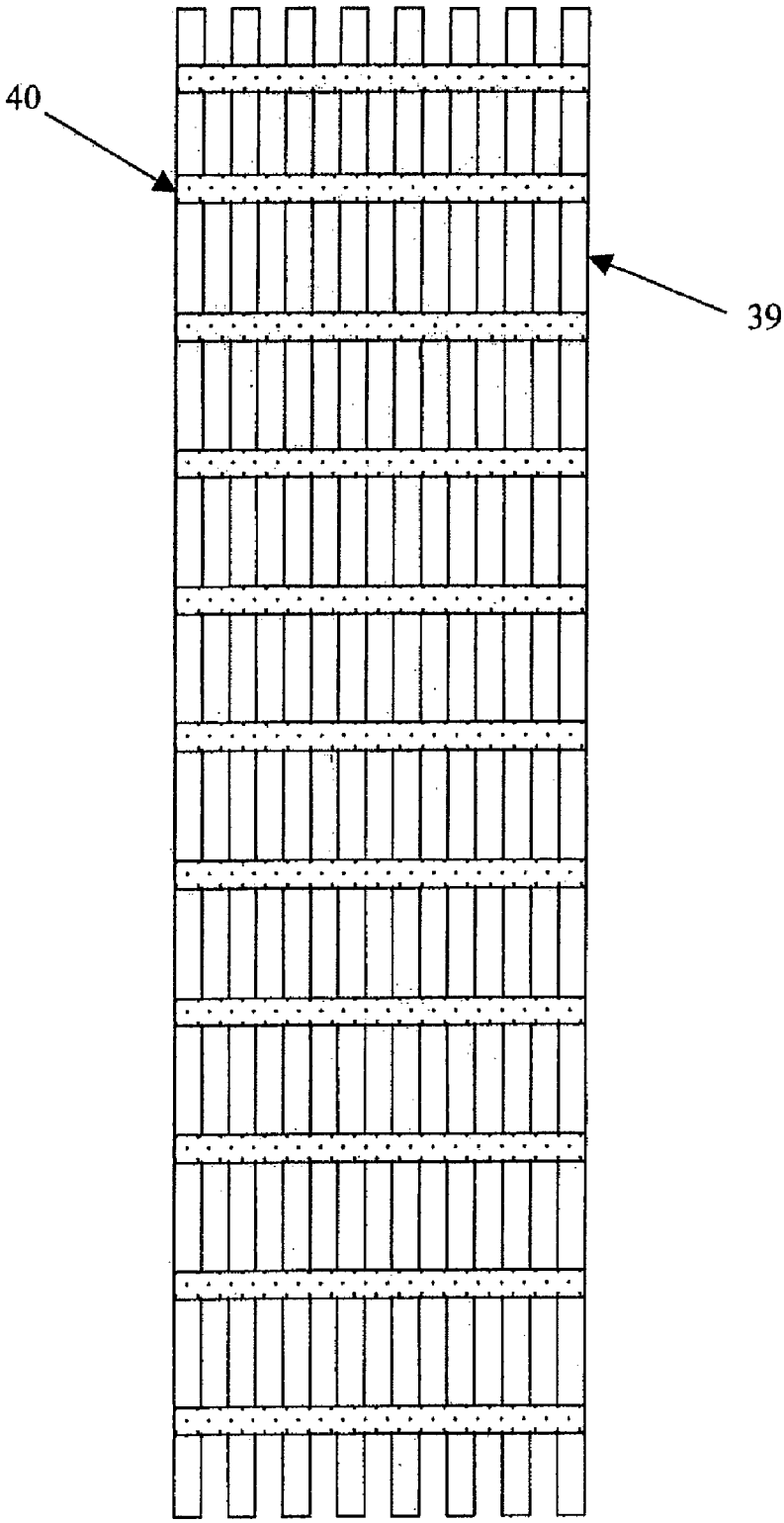
FIG. 4 is a plan view of an alternative embodiment of a cooling spacer.

In another embodiment illustrated in FIG. 4, a spacer includes parallel strips 39 extending circumferentially about the coil 34. The parallel strips may be linked for placement about the coil 34 using several thin strips of tape 40, or with magnet wire that is fused together into strips using heat. A non-conducting material, such as Kapton™ tape commercially available from E.I. du Pont de Nemours and Company, may be used to connect the parallel strips. Each spacer may include any number of strips per layer, such as approximately 8 to 16 strips per layer, and each strip may have an appropriate width, such as approximately ⅛ to ¼ inches. The parallel strips are arranged about the core 28 such that the parallel strips extend circumferentially, and as fluid is introduced into the electromagnet 10, the parallel strips act to distribute the fluid circumferentially.

Although the spacer 30 is shown as having inner 36 and outer 38 grooves and alternatively described as having parallel strips, it is understood that the spacer may include any number of different configurations to ensure that the fluid is distributed about the windings 32 of the coil 34. For example, the spacer 30 could include radial grooves in a mesh pattern as opposed to diagonal grooves, strips extending substantially longitudinally along each winding 32 as opposed to circumferentially about the core 28, or other similar type of pattern. It is only required that there be a channel to distribute fluid about the coil 34, as a solid spacer would inhibit such distribution.

The spacer 30 is preferably manufactured by machining or molding. The spacer 30 may be substantially planar, as shown in FIG. 2, prior to machining. The spacer 30 may then have its inner grooves 36 formed by machining parallel grooves, such as to a depth of approximately one half of the material thickness, and subsequently machining a series of similar outer grooves 38, also to about one half of the material thickness, for example, on the opposite surface of the spacer to create the mesh pattern shown in FIG. 2. The spacer 30 may then be easily cut to a desired width and length depending on the width and length of the winding 32 incorporated into the coil 34. Thus, the sizing and placement of the spacer 30 may be precisely controlled to ensure proper coolant flow through the electromagnet 10. It is also understood that the spacer 30 could be formed with a method such as compression molding, injection molding, or similar molding process to manufacture a spacer having inner 36 and outer 38 grooves.

Figure 5:
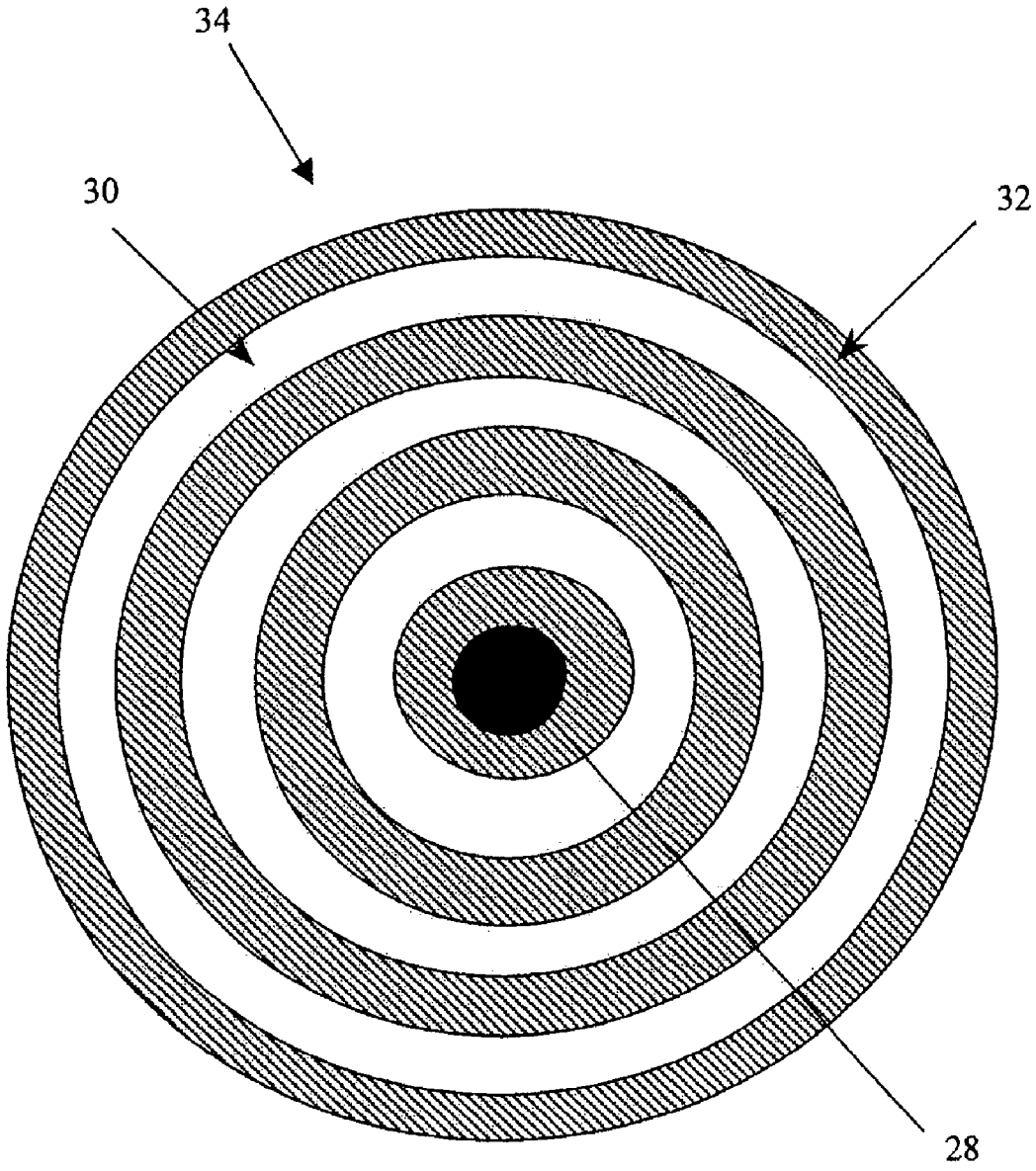
FIG. 5 is a cross-sectional view of cooling spacers and a coil comprising windings wrapped about a core according to one embodiment of the present invention.

The spacers 30 may be made of any type of material with a high melting temperature that is also, preferably, non-abrasive and non-conductive, such as Teflon™ material, commercially available from E.I. du Pont de Nemours and Company, fiberglass, or a weave material. The spacer 30 is wrapped in a circular configuration when positioned adjacent to the coil 34, as shown in FIGS. 3 and 5. Thus, the circumference of the spacer 30 is easily adjusted by properly cutting or otherwise sizing the spacer to accommodate different circumferences of the windings 32 of the coil 34 to ensure that all inner and outer exposed surfaces of each winding 32 are adjacent to a spacer. Therefore, the spacer 30 is advantageously formed of a material that is flexible but stiff enough to maintain its shape about the coil 34. However, the spacer 26 must not be so stiff as to damage the coating of the underlying winding 32, as most windings are commonly insulated with a coating such as formvar or polyimide. Although the spacer 30 is shown as having a circular configuration, it is understood that the spacer could be formed into other shapes to extend circumferentially about cores 28 of various cross sections.

Generally for most effective cooling, either one or two layers of windings 32 of wire will be placed between each spacer 30. FIG. 5 illustrates that one layer of winding 32 is adjacent to a spacer 30 on both sides of the winding, with the electromagnet having five windings and three spacers. It is understood that more than two layers of windings 32 could be disposed between spacers 30, but this design would decrease the cooling capability of the fluid entering the electromagnet 10, as the windings furthest from the spacer 30, i.e., those windings not in physical contact with a spacer, will not be cooled as much or as efficiently as those windings that are immediately adjacent to a spacer.

Cooling may occur by circulating fluid around the windings 32 comprising the coil 34 of the electromagnet 10. Thus, an airflow generator, such as a source of compressed air or another source of coolant, may be connected in fluid communication with the electromagnet 10 in any manner known to those skilled in the art. Alternatively, the fluid may be forced through the electromagnet 10 with a low-pressure pump or the like by pumping fluid through inner housing 14 of the electromagnet 10 that encloses the coil 34 and/or around the coil 34. The pumping system may cool the fluid, and as the fluid enters the electromagnet 10, the electromagnet is cooled. FIG. 1 illustrates that fluid may enter the electromagnet 10 at one or more inlets 24, but the fluid flow may begin at any other appropriate location. Regardless of the type of cool, the fluid utilized to cool the coil 34 may be any type of coolant, such as air, water, glycol, any other type of gas, or other liquid, such as Fluorinert™ coolant, commercially available from the Minnesota Mining and Manufacturing Company.

FIG. 1 illustrates one embodiment of a fluid flow path in which the fluid is routed into and through the distribution channels 22 defined in the endplate 16 of the electromagnet. The distribution channels 22 are generally machined into the endplate 16 or backiron, and if these components form part of the magnetic circuit, the machining of the distribution channels will have will have minimal impact on the flux efficiency of the coil 34. It is understood that the distribution channels 22 may be defined in either endplate 16, 18, or both concurrently. The distribution channels 22 act to allocate fluid relatively evenly across the entire radial expanse of the coil 34, and could be any "serpentine" or like configuration to ensure that the fluid is distributed about the coil.

The fluid enters the inlet 24 defined within the endplate 16 and is circulated through the distribution channels 22 to disperse the fluid radially and circumferentially prior to entering the coil 34. The fluid then enters the coil 34 and is dispersed longitudinally and circumferentially through the spacers 30 due to the mesh pattern defined within the spacer. The fluid acts to cool the windings 36 through convection, as the lower temperature of the fluid acts to draw away heat from the windings 32. The fluid then exits through the outlet 26 defined within the endplate 18. The fluid may exit at any other desired location, or may be circulated back to the inlet 24 for further cooling. In the case of air cooled electromagnets, the air may escape into the atmosphere. It is understood that an air generator could be used to force air within the electromagnet 10, or a pump could be used to force fluid through the electromagnet.

Figure 6:
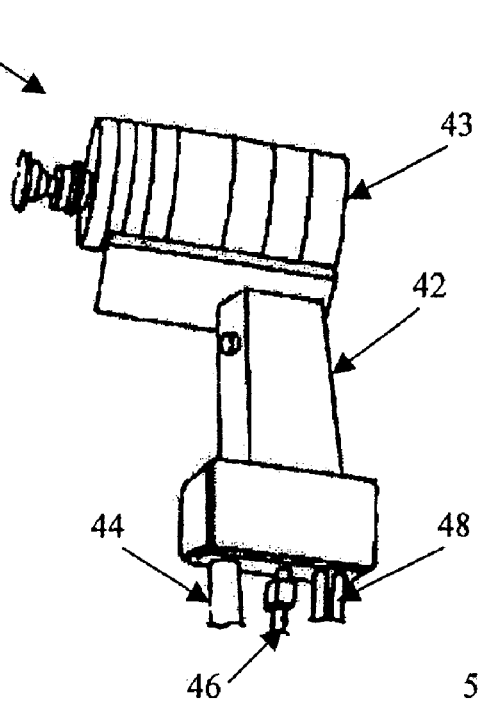
FIG. 6 is a perspective view of another embodiment of the present invention showing a rivet gun having an electromagnet with a cooling spacer therein.
Figure 7:
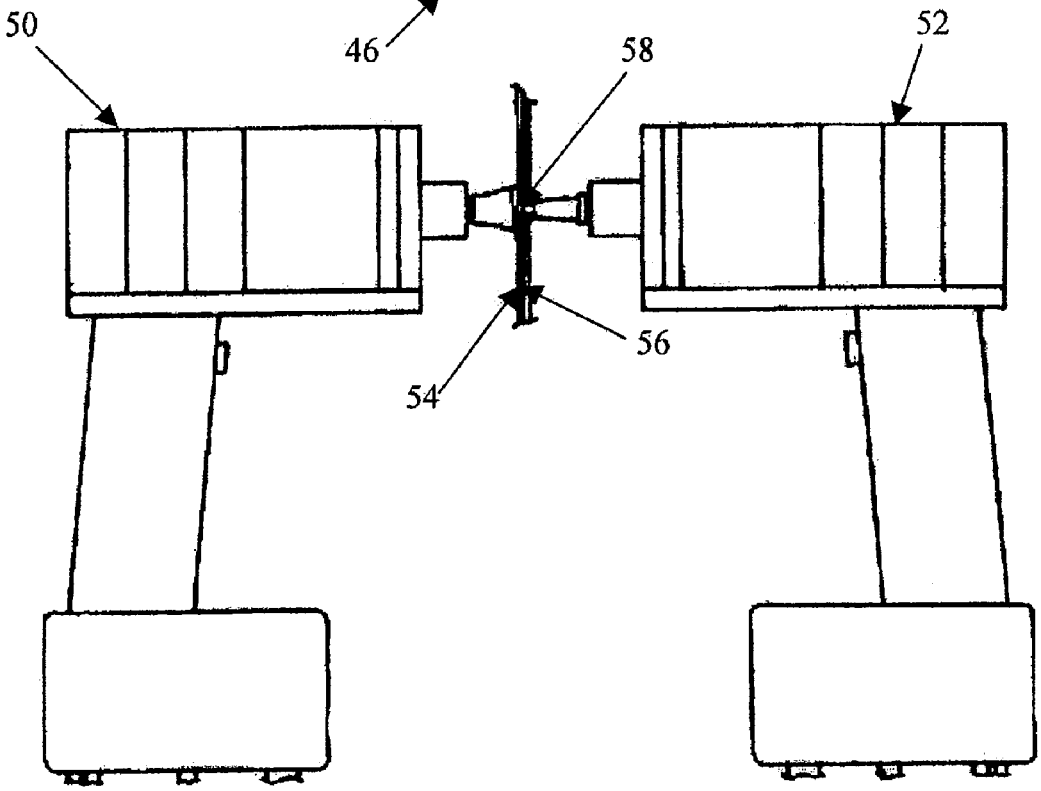
FIG. 7 is a side view of a synchronized rivet-gun system in accordance with another embodiment of the present invention.

In one embodiment of the present invention, the electromagnet is advantageously adapted for use with a synchronized rivet gun system, as shown in FIGS. 6 and 7. The rivet gun system advantageously provides a riveting process with reduced noise and improved uniformity of the formed rivets. FIG. 6 illustrates that the rivet gun 41 includes a handle 42 and a housing 43, wherein the housing encloses the electromagnet 10. The rivet gun 41 further includes an electrical socket 44, optical sensor socket 46, and a fluid socket 48. The fluid socket 48 provides an inlet and outlet for coolant entering the electromagnet 10, while the electrical socket 44 provides a current to the coil 34 to magnetize the core 28. FIG. 7 illustrates two rivet guns 50, 52, wherein the rivet guns act concurrently to secure two sheets of sheet metal 54, 56 with a rivet 58. Further details regarding the synchronized rivet gun system are included in U.S. patent application Ser. No. 10/214,049, filed on Aug. 6, 2002, and entitled "Synchronized Rivet Gun System," which is incorporated herein by reference.

The electromagnet 10 of the present invention is also useful in any number of other applications in which a current source is electrically connected to the electromagnet 10 so as to selectively magnetize the electromagnet. For example, the electromagnet 10 could be used with a clamp for holding large workpieces together or holding a single workpiece in place. U.S. patent application Ser. No. 10/424,462, filed Apr. 28, 2003, and entitled "An Electromagnetic Clamp and Method for Clamping a Structure," provides additional disclosure on such clamping and is incorporated herein by reference. Other examples of clamps utilizing electromagnets include: U.S. Pat. No. 6,357,101 to Sarh et al., a "Method for Installing Fasteners in a Workpiece," and is incorporated herein by reference; and U.S. Patent Publication No. 2003/0221306, filed on May 30, 2002, and entitled "Apparatus and Method for Drilling Holes and Optionally Inserting Fasteners," which is incorporated herein by reference.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of cooling an electromagnet, the method comprising:

providing an electromagnet comprising at least one spacer defining channels therein and a coil comprising at least one winding, the at least one spacer and winding each extending completely about a circumference of a core, the spacer having a first end and a second end spaced apart from one another along a longitudinal axis of the core, the channels extending non-parallel to the longitudinal axis of the core and between the first and second ends of the spacer, the winding comprising an inner surface and an outer surface, wherein the entire inner or outer surface of the winding extends adjacent to the spacer completely about the circumference of the core, wherein the electromagnet further comprises a first endplate defining an inlet and a second endplate defining an outlet, and wherein a housing extends circumferentially about the winding and spacer and between the first and second endplates such that the coil and spacer are enclosed;

magnetizing the electromagnet by providing a current to the coil; and supplying a cooling medium into the inlet defined within the first endplate such that the cooling medium flows through the channels of the spacer in a direction non-parallel to a longitudinal axis of the core and out of the outlet defined within the second endplate, and wherein supplying the cooling medium cools the electromagnet.

2. A method according to claim 1, the method further comprising supplying the cooling medium about serpentine channels defined with the first endplate prior to reaching the channels of the spacer.

3. A method according to claim 1, wherein providing the electromagnet comprises providing a spacer defining a lattice of diagonally extending channels therein.

4. A method according to claim 1, wherein providing the electromagnet comprises providing a spacer having channels extending in a generally circumferential direction about the core.

5. A method according to claim 4, wherein providing the electromagnet comprises providing a spacer having linked parallel strips.

6. A method according to claim 1, further comprising providing alternating windings and spacers circumferentially about the core such that each spacer is adjacent to a winding.

7. A method of cooling an electromagnet, the method comprising:

providing an electromagnet comprising at least one spacer defining channels therein and a coil comprising at least one winding, wherein the winding and spacer extend adjacent and circumferentially about a core, the spacer having a first end and a second end spaced apart from one another along a longitudinal axis of the core, the channels extending non-parallel to the longitudinal axis of the core and between the first and second ends of the spacer, wherein the electromagnet further comprises a first endplate defining an inlet and a second endplate defining an outlet, the first end plate comprising first and second opposing surfaces and a thickness extending therebetween and further comprising serpentine channels defined in the first surface and at least partially within the thickness of the first end plate, and wherein a housing extends circumferentially about the winding and spacer and between the first and second endplates such that the coil and spacer are enclosed;

magnetizing the electromagnet by providing a current to the coil; and supplying a cooling medium into the inlet defined within the first endplate and through the channels of the spacer and out of the outlet defined within the second endplate, and wherein supplying the cooling medium cools the electromagnet, wherein supplying comprises supplying the cooling medium about the serpentine channels defined within the first endplate so as to distribute the cooling medium across a radial expanse of the coil prior to entering the channels of the spacer.

8. A method of cooling an electromagnet, the method comprising:

providing an electromagnet comprising at least one spacer defining channels therein, the spacer having a first end and a second end spaced apart from one another along a longitudinal axis of a core, wherein the channels are defined within an inner or outer surface of the spacer such that the channels extend in a non-parallel direction about the longitudinal axis of the core and between the first and second ends of the spacer, the electromagnet further comprising a coil comprising at least one winding, wherein the winding and spacer extend adjacent and circumferentially about the core, wherein the electromagnet further comprises a first endplate defining an inlet and a second endplate defining an outlet, and wherein a housing extends circumferentially about the winding and spacer and between the first and second endplates such that the coil and spacer are enclosed;

magnetizing the electromagnet by providing a current to the coil; and supplying a cooling medium into the inlet defined within the first endplate and through the channels of the spacer and out of the outlet defined within the second endplate, and wherein supplying the cooling medium cools the electromagnet.

9. The method of claim 1, wherein said providing comprises providing at least one spacer and at least one winding each having a circular cross section and an opening defined therethrough for receiving the core.

10. The method of claim 1, wherein said providing comprises providing, between at least a pair of windings, at least one spacer having an inner surface and an outer surface, and wherein the inner or outer surface of the spacer cooperates with the outer or inner surface of one of the pair of windings, respectively, to define a plurality of channels therebetween.

11. The method of claim 10, wherein the inner surface of the spacer cooperates with the outer surface of one of the pair of windings to define a plurality of channels therebetween and the outer surface of the spacer cooperates with the inner surface of the other of the pair of windings to define a plurality of channels therebetween.

12. The method of claim 7, wherein said providing comprises providing at least one spacer and at least one winding each having a circular cross section and an opening defined therethrough for receiving the core.

13. The method of claim 7, wherein said providing comprises providing at least one spacer and at least one winding each having an inner surface and an outer surface, and wherein the inner or outer surface of the spacer cooperates with the outer or inner surface of one of the pair of windings, respectively, to define a plurality of channels therebetween.

14. The method of claim 8, wherein said providing comprises providing at least one spacer and at least one winding each having a circular cross section and an opening defined therethrough for receiving the core.

15. The method of claim 8, wherein said providing comprises providing at least one winding having an inner surface and an outer surface, and wherein the inner or outer surface of the spacer cooperates with the outer or inner surface of one of the pair of windings, respectively, to define a plurality of channels therebetween.

16. The method of claim 1, wherein said supplying comprises supplying the cooling medium such that the cooling medium flows through the channels of the spacer in a diagonal direction with respect to the longitudinal axis of the core.

17. The method of claim 1, wherein said supplying comprises supplying the cooling medium such that the cooling medium flows through the channels of the spacer in a direction generally perpendicular to the longitudinal axis of the core.

18. The method of claim 3, wherein said providing comprises providing a spacer having an inner surface and an outer surface and a lattice of diagonally extending channels defined in both the inner and outer surfaces of the spacer.

19. The method of claim 18, wherein said providing comprises providing a spacer having diagonally extending channels defined in the inner surface of the spacer that extend at a different direction to diagonally extending channels defined in the outer surface of the spacer.

20. The method of claim 7, wherein said supplying comprises supplying a cooling medium into the inlet defined within the first endplate such that the cooling medium flows through the channels of the spacer in a direction generally non-parallel to a longitudinal axis of the core.

* * * * *